US005823212A

United States Patent [19]

Allen

[11] Patent Number: 5,823,212

[45] Date of Patent: Oct. 20, 1998

[54] STADIUM UMBRELLA

[76] Inventor: Richard B. Allen, 2400 Hudson Ter., Apt. 2H, Fort Lee, N.J. 07024

[21] Appl. No.: 328,159

[22] Filed: Oct. 24, 1994

Related U.S. Application Data

[63] Continuation of Ser. No. 066,788, May 24, 1993, abandoned.

[51] Int. Cl.[6] ..... A45B 3/00

[52] U.S. Cl. ..... 135/16; 135/33.2; 135/33.7

[58] Field of Search ..... 135/16, 33.2, 33.4, 135/33.41, 33.7, 33.71, 33.6

[56] References Cited

U.S. PATENT DOCUMENTS

| | | | |
|---|---|---|---|
| 664,157 | 12/1900 | Killmer | 135/33.2 |
| 1,706,341 | 3/1929 | Zussman . | |
| 2,551,297 | 5/1951 | Sherman | 135/33.2 |
| 2,985,179 | 5/1961 | Givens | 135/33.2 X |
| 3,146,785 | 9/1964 | Iwashita . | |
| 3,498,306 | 3/1970 | Edelking | 135/33.2 |
| 3,739,792 | 6/1973 | Holland | 135/16 |
| 4,022,233 | 5/1977 | Grundman | 135/33.2 X |
| 4,271,604 | 6/1981 | Rowsey, Jr. | 135/33.2 X |
| 4,838,290 | 6/1989 | Wu | 135/16 X |

FOREIGN PATENT DOCUMENTS

| | | | |
|---|---|---|---|
| 2617689 | 1/1989 | France | 135/16 |
| 4037087 | 5/1992 | Germany | 135/33.2 |
| 1524515 | 9/1978 | United Kingdom | 135/16 |

*Primary Examiner*—Lanna Mai
*Attorney, Agent, or Firm*—William F. Pinsak

[57] ABSTRACT

This invention relates to an improved umbrella design, the cover of which is of a transparent, as opposed to opaque, material. The umbrella is in the shape of a dome-topped cylinder, the diameter of which approximates the width of an average person's shoulders. In one embodiment, the umbrella cover encompasses the torso of the user; in another, only the head and upper body. The umbrella further includes a DC motor and a wiper blade for wiping precipitation from that segment of the cover immediately in front of the user's face, to enhance vision.

12 Claims, 3 Drawing Sheets

STADIUM UMBRELLA

This invention is a continuation of U.S. Pat. application Ser. No. 08/066,788, filed on May 24, 1993, now abandoned.

BACKGROUND OF THE INVENTION

This invention relates generally to an umbrella having a unique shape, covered by a transparent material and equipped with a wiper blade to afford the user an unrestricted view during inclement weather.

It is common knowledge and irrefutable that millions of people attend outdoor events in facilities, such as football stadiums, and outdoor playing fields. While certain events, such as baseball and tennis, may be postponed or called because of inclement weather, others continue even in the most adverse weather conditions. For the die-hard fan who wishes to remain throughout the contest, no matter what the weather, protection from the elements can be a serious problem.

Conventional umbrellas have been banned from most stadiums. One of the principal reasons is that each attendee is allocated approximately two feet of space, little more than the average shoulder width.

When a fan purchases a ticket to a sporting event, he is in reality renting, for the duration of the contest, a cylindrical space in the stadium which is defined by the dimensions of the seat and which extend essentially to the top of his/her head. The space allocated does not vary from stadium to stadium, but is relatively constant and precisely determined.

The width of the rented space approximates the width of the shoulders of an average person. It is for this reason that normal umbrellas are banned from stadiums. They extend beyond the rented space and interfere with, impose upon or infringe into the adjacent space rented by the surrounding fans.

Umbrellas come in many sizes, but are generally of a diameter of from four to five feet, when opened. Obviously, if everyone in a stadium opened an umbrella at the same time, there would be a considerable amount of overlap in all directions.

The person seated behind an umbrella user would generally have an umbrella in his or her lap or face. To further complicate matters, umbrellas are usually covered by materials which are opaque, thereby making it virtually impossible to view the proceedings on the field.

There is, of course, the inherent danger to those in close proximity caused by the tips of the frame members, or, ribs, of the conventional umbrella.

With the abolition of conventional umbrellas from the stadiums, the sports fan is left with few alternatives. He can either don foul weather gear or leave the stadium.

This invention is directed to an improved umbrella design in cooperation with a wiper blade, which overcomes the aforementioned difficulties and problems.

SUMMARY OF THE INVENTION

The umbrella of this invention is fabricated so that, when in an "extended" position, i.e., fully opened, its outer diameter approximates the width of a person's upper body. In one embodiment, it extends the length of a person's torso.

When opened, this umbrella approximates the shape of a dome-topped cylinder which surrounds the torso of the user. Thus, the space occupied by the umbrella, when opened, is little more than that occupied by a person without the umbrella.

The geometric definition of a cylinder is "a figure described by the edge of a rectangle rotated around the parallel edge as axis; the ends of a cylinder are equal circles." Applied to the instant invention, the lowermost portion of the umbrella cover can be likened to one edge of the rectangle and the shaft, or handle, of the umbrella, to the other edge.

The ribs of the umbrella of the instant invention, at their lowermost extension, are parallel to each other and to the umbrella handle. That is to say, the lowermost portion of the cover is in the form of a cylinder, wherein both "ends" are of the same diameter. If this were not so, the purpose of the invention would be defeated, as the peripheral edge of the umbrella would once again infringe into the space occupied by an adjacent person.

The uniquely shaped umbrella of this invention further comprises a transparent cover in combination with a wiper motor and blade in order not only to provide shelter during inclement weather, but also to afford the user and those behind a virtually unobstructed view of the action on the field.

The motor for the wiper is situated at the very top of the umbrella and actuates a wiper which extends downwardly to clear precipitation from that section immediately forward of the face of the user.

The motor is activated by a battery pack which may be attached inside the umbrella, carried by the user or incorporated into the handle of the umbrella.

The clear plastic not only permits the user and others to see through the umbrella, but also provides a medium for the placement of team logos or other commercial advertising. Such indicia would be located at either or both sides of the umbrella.

It is, therefore, an object of this invention to provide an improved umbrella of a new and unique configuration.

It is still another object of this invention to provide an umbrella, the cover of which extends downwardly to closely surround the shoulders of the user.

It is a further object of this invention to provide an umbrella in combination with a wiper to remove precipitation from a portion of said transparent cover.

Still another object of this invention is to provide an umbrella assembly which accomplishes all of the above objects and which is of compact design and which is economical to manufacture.

Other objects will become apparent upon a reading of the following description of a preferred and an alternate embodiment.

BRIEF DESCRIPTION OF THE DRAWINGS

The present invention is illustrated hereinafter by a detailed description of the preferred and one alternate embodiment, presented in conjunction with, and by reference to, the accompanying drawings, in which like reference characters refer to like or corresponding parts, and wherein.

DETAILED DESCRIPTION OF THE PREFERRED EMBODIMENT

Figure 1:
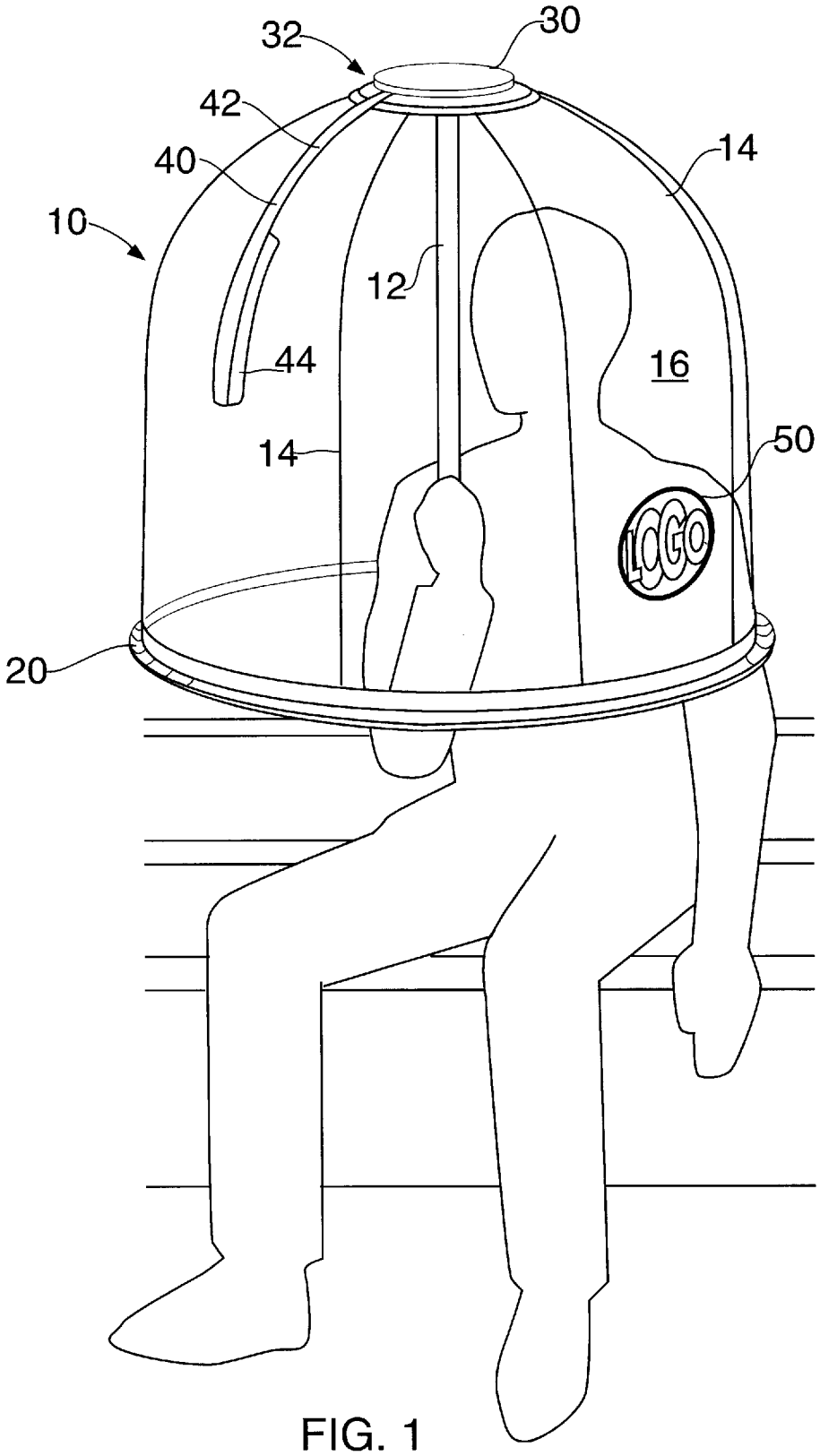
FIG. 1 is a perspective view of an umbrella embodying this invention, showing the umbrella in an operative position.

The preferred embodiment illustrated is not intended to be exhaustive or to limit the invention to the precise form disclosed. It has been chosen and is herein described in order to best explain the invention and its practical use to enable others skilled in the art to best utilize the invention.

Certain terminology will be used in the description for convenience in reference only and will not be limiting. For example, the words "upwardly" and "downwardly" will refer to direction relative to the vertical axis of the umbrella and of the body of the user of the umbrella. Words such as "uppermost" will refer to that arcuate portion of the umbrella which is closed to protect the user from the elements when the umbrella is in its open configuration; "lowermost" will refer to that portion of the umbrella which extends downwardly when the umbrella is in use. The "bottom", "rim" or "lip" of the umbrella is where the cover is attached to the tips of the ribs, i.e., the lowest circumferential, peripheral or distal edge of the umbrella when in an open attitude. The "height", or, "depth", of the umbrella will refer to the vertical distance from the top of the cover to the botttom edge of the cover when the umbrella is open and in a vertical attitude. Words such as "inwardly" and "outwardly" will respectively refer to direction toward and away from the geometric center of the umbrella assembly and designated parts thereof. Said terminology will include the words specifically mentioned, derivatives thereof, and words of similar import. The terms "cover" and "canopy" are herein used to refer to the material which constitutes the umbrella "fabric" and are not meant to be limiting.

We will commence with the understanding that an umbrella is generally comprised of an elongated shaft, at one end of which are pivotally fixed a plurality of ribs. Each rib has an arm which is pivotally fixed to each respective rib and to a ring which surrounds the shaft and is movable upwardly and downwardly along said shaft.

A cover, generally of an opaque fabric, is fixed to the top of the shaft and to all of the ribs. In this fashion, when the ring is slided upwardly, the ribs are extended outwardly and the cover is stretched to form the protective canopy.

Referring to the Figures, reference numeral 10 generally designates the umbrella of this invention. As with conventional umbrellas, umbrella 10 is composed of central shaft 12, to which are attached a plurality of ribs 14, to which in turn is attached cover 16.

Not illustrated, in order not to clutter the figures, and because their design is conventional, are the supporting arms which rigidly support the ribs in their extended or open position.

The structure and action of the basic umbrella is conventional. If one examines an umbrella it is noted that the ribs themselves are quite flexible and the shape of the open umbrella is determined by the cover. That is to say, the cover is pre-formed and is attached at a plurality of points to the ribs.

When the mechanism is activated to open the umbrella, the ribs extend to the limit permitted by the cover. It is for this reason that some umbrellas have a shallower pitch, or, less curvature, than others. The pitch or curvature of the umbrella, when open, is defined by both the length of the ribs and the circumference or the perimeter of the covering.

Normally, the "depth" of an umbrella is 20 to 25% of the diameter of the umbrella when open. That is to say, a conventional umbrella is relatively flat. This may be contrasted to the umbrella of this invention, the uppermost portion of which is of a "dome" or "hemispherical" shape, wherein the radius of the hemisphere is its height, or, depth, and the diameter of the hemisphere, by virtue of its geometric definition, is its width.

To further specify the shape of the umbrella of this invention, the depth of the cylindrical portion of the umbrella is, in one embodiment, equal to the radius of the dome-shaped upper portion. Put another way, the lowermost portion, or half, of the umbrella, that which is cylindrical, is of a vertical dimension equal to the radius of the dome-shaped upper portion. The diameter of the cylinder is the diameter of the dome (hemisphere). The resulting umbrella, in one of its embodiments, has a configuration wherein the diameter of the lowermost (cylindrical) portion approximates the total vertical height of the umbrella cover (see FIG. 2).

As illustrated in FIG. 1, the ribs of this embodiment of the instant invention are half again to twice the length of standard ribs, and their curvature is determined by the cover.

Cover 16 represents a radical departure from the normal umbrella cover. As pointed out above, the uppermost portion of cover 16 can be described as dome-shaped or hemispherical, with the lowermost portion in the shape of a cylinder. That is to say, at the lowermost portion of the umbrella, when the umbrella is opened, the ribs are drawn toward the handle to the extent that they are in a plane parallel with the handle, thereby defining the cylindrical shape. The cylinder has a diameter slightly in excess of the width of the shoulders of an average person.

Figure 2:
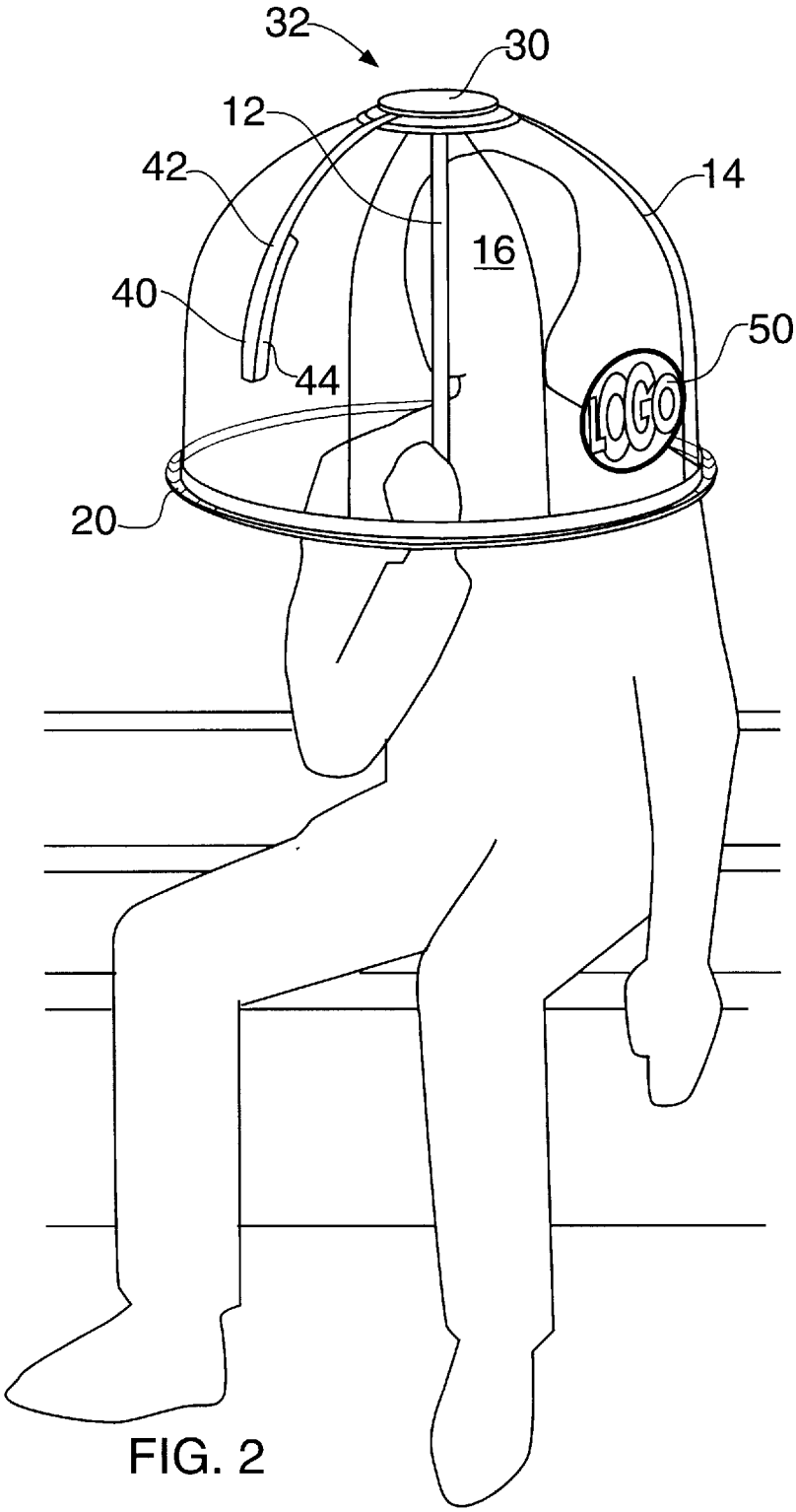
FIG. 2 is a perspective view of an alternate umbrella, also embodying this invention, showing the alternate umbrella in an operative position.

As will be obvious from FIG. 2, the diameter of the cylindrical portion of cover 16 is approximately equal to the total height, or, depth, of umbrella 10. In this embodiment, the dome-shaped, or, hemispherically-shaped, top, comprises one-half of the cover of the umbrella. The lower portion of the cover is, as previously stated, cylindrical in shape. The height, or, depth, of the umbrella is approximately equal to the diameter of the cylindrical portion.

Reverting to FIG. 1, it will be seen that in this embodiment, as previously noted, the cylindrical portion of umbrella 10 extends downwardly to protect a greater portion of the torso of the user. The height, or, depth, of the umbrella of this embodiment, is from one-and-one-half to twice the diameter of the cylindrical portion. In this embodiment, the cylindrical shape of the lower portion of the umbrella cover is more obvious and pronounced.

Because of the tension and the strain placed on ribs 14 by the restrictive shape of cover 16, there is a reinforcement 20 at the bottom of cover 16, where cover 16 is attached to the tips of ribs 14. In order to understand the need for such reinforcement, one must visualize an archer's bow and then equate it to two corresponding and oppositely located ribs of the umbrella, attached to the center pole. The center pole may be likened to the archer's arm. As the archer draws the string, the tips of the bow extend further back and closer together. As the archer draws further and further, the tension of the bow increases more and more.

Reverting to the umbrella, the lip of the cover, attached to the tips of the ribs, defines the diameter of the umbrella, at its open position. As the circumference of the cover is reduced more and more to reduce the diameter of the umbrella, the tension exerted by the ribs grows stronger. Unless the lip is reinforced, because of the shape of the instant invention, the pressure exerted by the ribs could rend the material.

In actual use, reinforcement 20 is preferably a molded lip secured as a means to channel and direct the flow of precipitation. Thus, rather than dripping from the cover haphazardly, the precipitation is directed to a given drainage point, to the rear or side of the umbrella. When used to channel precipitation, reinforcement 20 is in the shape of a "U" or a reverse "J". Reinforcement 20 is applied to cover 16 during fabrication.

Because cover 16 extends downwardly to cover the torso of the user, it cannot be of the standard opaque material from which umbrella covers are normally made. Cover 16 is made of a transparent material, of which there are any number of suitable plastics or vinyls.

The entire cover 16 is made of the same material, in order that not only the user, but also anyone to the side or to the rear, can see through it.

Fixed to the top of shaft 12 is disc-like housing 30, which is supported immediately above and adjacent to cover 16 and the upper portion of ribs 14. Housing 30 contains a small DC motor 32 (FIG. 3) which operates wiper 40.

Wiper motor 32 is of conventional design and is of the standard reciprocating type used to impart motion to, for example, vehicle mounted windshield wipers. Wiper motor 32 is contained inside a cylindrical housing having a slotted opening 52 through which extends wiper arm 42.

Wiper arm 42 is curved to match the contour of cover 16 and extends downwardly a distance sufficient to reach the area of cover 16 through which the user is viewing. Wiper blade 44 is of conventional design and may be a simple strip of rubber, or the like, as in a squeegee, or an automotive-type windshield wiper.

Figure 3:
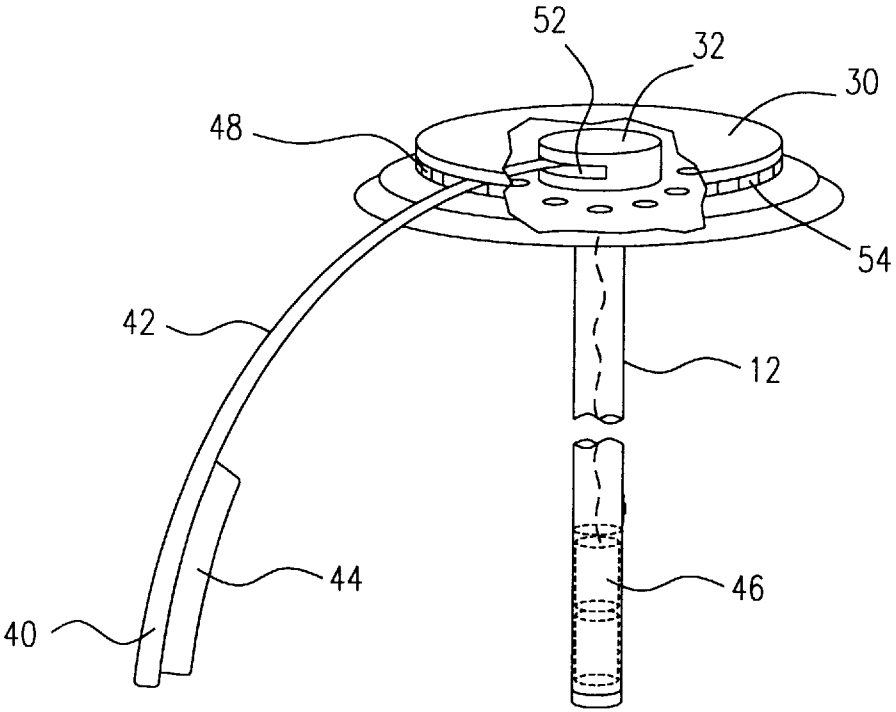
FIG. 3 is a partial elevational, partional sectional, view of the wiper motor, the venting means and the battery compartment of the umbrella of this invention.

Wiper motor 32 is operated by a battery pack which, in its preferred form, could be incorporated into the handle of or within shaft 12, as depicted in FIG. 3. It will, of course, be understood that the battery pack could be removably attached, by any acceptable means, to the umbrella shaft, or be carried by the user.

It will also be understood that in actual practice, housing 30 could be manufactured as a separate assembly which could be sold separately and which could be carried separately and be fixed to shaft 12 by the user of the umbrella. An individual might own more than one umbrella, e.g., one of each embodiment, and need only one wiper assembly, which he/she would mount on either umbrella interchangeably.

Cover 16 of this invention also lends itself to the display of the insignia or identification of the favorite school or team of the owner/user of the umbrella.

Because the body of cover 16, as illustrated in FIG. 1, extends downwardly below the shoulders of the user, identification could be placed at the lower portion of each panel of cover 16, without affecting visibility.

By way of example, and not of limitation, a generic logo 50 is illustrated on the side panel of cover 16. The many varieties of such an indicia are unlimited, and would indicate the favorite team of the particular fan.

Logo 50 is applied by any conventional means, and may be decalcomania, a silkscreen application, or any other suitable impression, applied to the inside of cover 16 during fabrication thereof.

It will be understood that the nature of logo 50 is unlimited and may extend to corporate or organizational logos as well as to team or school logos and identification.

While the preferred embodiment utilizes a clear cover, it will be understood and appreciated that vinyl and plastic sheet come in colors which are also transparent or "see-through", in the same sense that sun glasses come in many colors.

Figure 4:
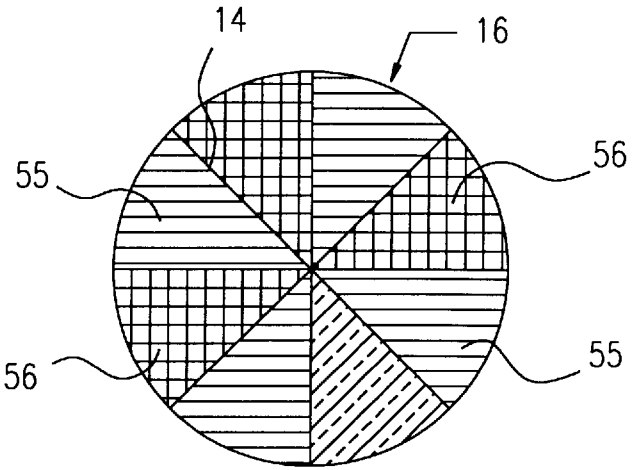
FIG. 4 is a top view of the umbrella, without the motor and wiper, showing the transparent but fully tinted, alternating colored panels of the umbrella of this invention.

Without limiting the invention, it may be seen as illustrated in FIG. 4 that team colors may be represented on the cover without departing from the scope of the invention. In other words, if team or school colors are, e.g., maize and blue, or maroon and gold, etc., alternating panels 55–56 of the umbrella would be of these colors and still be transparent.

Due to the limited space, and the temperature differential caused by the users breathing, the interior of umbrella 10 has a tendency to fog. To obviate this condition, venting means 48 are provided in housing 30, in cooperation with small holes 54 at the bottom of housing 30 and at the top of cover 16, such venting means being located in such a position as to be protected by housing 30, thereby permitting air to escape and preventing precipitation from entering.

In summary, the embodiment illustrated in FIG. 2 differs from that illustrated in FIG. 1 only in the vertical extent of ribs 14. In one embodiment, cover 16 extends to a point slightly below the shoulders of the user, in the other, it encompasses the entire torso. In both, however, the diameter of the umbrella only slightly exceeds the width of a user's shoulders. The lowermost portion of the umbrella, in both embodiments, is in the shape of a cylinder. Any other configuration defeats the purpose of the unique shape of the umbrella of this invention, because any other umbrella would invade the space of the adjacent fans.

All other components are virtualy identical. It will be understood, of course, that, since the cover of FIG. 2 is much smaller, logo 50 will be applied only at one or both sides, in order not to obscure vision.

While it is acknowledged that the prime environment for this invention is in a stadium or at an outdoor athletic event, its use is not so limited. As is known, strong winds wreak havoc on conventional umbrellas. The umbrella of this invention, because of its "bullet" shape, is capable of withstanding greater wind stresses and will not easily tear apart in severe winds.

From the preceding description, it is evident that the objects of the invention are attained. Although the invention has been described and illustrated in detail, it is to clearly understood that the same is intended by way of illustration and example only and is not to be taken by way of limitation. The spirit and scope of the invention are to be limited only by the terms of the appended claims.

What is claimed is:

1. An umbrella having a center pole and a handle at one end thereof, a plurality of ribs radiating from the other end thereof and a cover comprised of a plurality of panels defined by the number of ribs, said cover being secured to said center pole and to said ribs, wherein, when in an open mode, the cover assumes a cylindrical shape with a hemispherically shaped top, the lowermost portion of the ribs and cover thereof comprising said cylindrical portion, the edge of which is parallel to the axis of the said center pole, the diameter of said cylindrical portion approximating the vertical height of said cover, said cover of said umbrella being made of transparent material, to enable the user or any other person whose vision would otherwise be obstructed to see through said cover.

2. The umbrella of claim 1 having affixed to the handle thereof, adjacent to and immediately above the cover thereof, a disc-shaped housing in which is inserted a reciprocating DC motor for driving a wiper blade, a slotted opening to receive such a wiper blade, a wiper blade attached to and extending downwardly from said motor to a section of said cover in proximity to the line of sight of a user of said umbrella, said wiper blade to clear away precipitation from in front of the face of said user.

3. The umbrella of claim 2 further including venting means within said disc-shaped housing which permit the dissipation of air from within the cover of said umbrella and which are so located as to preclude the entry of precipitation.

4. The umbrella of claim 2 further including a plurality of batteries to supply energy to said motor to drive said wiper blade.

5. The umbrella of claim 4 wherein said handle of said umbrella is constructed and compartmented to receive said batteries.

6. The umbrella of claim 1 wherein the entirety of each of the panels of said transparent cover is tinted in a variety of solid colors, alternating from panel to panel.

7. An umbrella having a center pole with a handle at one end thereof, a plurality of ribs radiating from the other end thereof, and a cover comprised of a plurality of panels defined by the number of said ribs, said cover being secured to said center pole and to said ribs, wherein, when in an open mode, the umbrella assumes a shape wherein the lowermost portion is cylindrical and the uppermost portion is hemispherical or dome-shaped, the combined vertical dimension of said umbrella being 1.5 times to twice the diameter of said cylindrical portion, said cover of said umbrella being made of a transparent material, to enable the user or any other person whose vision would otherwise be obstructed to see through said cover.

8. The umbrella of claim 7 having affixed to the center pole thereof, adjacent to and immediately above the cover thereof, a disc-shaped housing in which is inserted a reciprocating DC motor for driving a wiper blade, a slotted opening to receive such a wiper blade, a wiper blade attached to and extending downwardly from said motor to a section of said cover to clear away precipitation from the line of sight of a user of said umbrella.

9. The umbrella of claim 8 further including venting means within said disc-shaped housing which permit the dissipation of air from within the cover of said umbrella and which are so located as to preclude the entry of precipitation.

10. The umbrella of claim 8 further including a plurality of batteries to supply energy to said motor to drive said wiper blade.

11. The umbrella of claim 10 wherein said handle of said umbrella is constructed and compartmented to receive said batteries.

12. The umbrella of claim 7 wherein the entirety of each of the panels of said transparent cover is tinted in a variety of solid colors, alternating from panel to panel.

* * * * *